US010487816B2

(12) United States Patent
Chou

(10) Patent No.: US 10,487,816 B2
(45) Date of Patent: Nov. 26, 2019

(54) AIR COMPRESSOR

(71) Applicant: Wen-San Chou, Tainan (TW)

(72) Inventor: Wen-San Chou, Tainan (TW)

( * ) Notice: Subject to any disclaimer, the term of this patent is extended or adjusted under 35 U.S.C. 154(b) by 296 days.

(21) Appl. No.: 15/405,288

(22) Filed: Jan. 12, 2017

(65) Prior Publication Data

US 2017/0204848 A1 Jul. 20, 2017

(30) Foreign Application Priority Data

Jan. 18, 2016 (TW) ..... 105101447

(51) Int. Cl.

| | |
|---|---|
| ***F04B 49/22*** | (2006.01) |
| ***F04B 53/10*** | (2006.01) |
| ***F04B 39/12*** | (2006.01) |
| ***F04B 41/02*** | (2006.01) |
| ***F04B 39/00*** | (2006.01) |
| ***F04B 39/10*** | (2006.01) |
| ***F04B 35/04*** | (2006.01) |
| ***F04B 39/14*** | (2006.01) |

(52) U.S. Cl.

CPC ..... *F04B 39/12* (2013.01); *F04B 35/04* (2013.01); *F04B 39/0005* (2013.01); *F04B 39/1066* (2013.01); *F04B 39/1073* (2013.01); *F04B 39/121* (2013.01); *F04B 39/122* (2013.01); *F04B 39/123* (2013.01); *F04B 39/14* (2013.01); *F04B 41/02* (2013.01); *F04B 49/22* (2013.01); *F04B 53/1085* (2013.01); *F05C 2225/00* (2013.01)

(58) Field of Classification Search

CPC ..... F04B 35/04; F04B 39/0005; F04B 39/10; F04B 39/122; F04B 39/123; F04B 39/125; F04B 39/14; F04B 49/22

See application file for complete search history.

(56) References Cited

U.S. PATENT DOCUMENTS

| | | | | |
|---|---|---|---|---|
| 3,179,055 A * | 4/1965 | Kalert, Jr. | F02M 1/00 | 417/395 |
| 4,565,507 A * | 1/1986 | Reimers | F04B 39/1073 | 137/512.15 |
| 4,957,419 A * | 9/1990 | Rascov | F04B 19/022 | 417/273 |
| 5,647,395 A * | 7/1997 | Hashimoto | F04B 39/1073 | 137/514 |
| 2008/0145245 A1* | 6/2008 | Chou | B29C 73/166 | 417/415 |
| 2012/0121443 A1* | 5/2012 | Chou | F04B 35/04 | 417/297 |
| 2014/0112812 A1* | 4/2014 | Takemi | F04B 39/121 | 417/571 |

* cited by examiner

*Primary Examiner* — Dominick L Plakkoottam

(57) ABSTRACT

An improved air compressor generally includes a cylinder fitted with a piston body, a main frame for mounting a motor, and an air storage container. The cylinder, which defines a plurality of exit holes, is formed integrally with the main frame. The compressed air produced in the cylinder can quickly enter the air storage container via the exit holes, so that the piston body can conduct reciprocating motion more smoothly and thus the performance of the air compressor can be increased.

8 Claims, 13 Drawing Sheets

AIR COMPRESSOR

TECHNICAL FIELD OF THE INVENTION

The present invention relates to an air compressor and, more particularly, to an improved air compressor which includes a cylinder being fitted with a piston body and defining a plurality of exit holes, and a main frame for mounting a motor, wherein the cylinder and frame are made of plastic, the cylinder is formed integrally with the main frame, and the compressed air produced in the cylinder may quickly enter an air storage container, so that the piston body can conduct reciprocating motion more smoothly and thus the performance of the air compressor can be increased.

DESCRIPTION OF THE PRIOR ART

Currently, an air compressor basically has a cylinder which allows a piston body to conduct reciprocating motion therein to produce compressed air which can overcome a valve mechanism, so that the compressed air can flow through an exit hole of the cylinder to enter the inner space of an air storage container or an air tank. The air storage container is provided with outlets for delivering the compressed air to an object to be inflated.

In conventional air compressors, there is only one exit hole defined at the cylinder for communicating with the air storage container. The exit hole of the cylinder is controlled by a valve mechanism, which generally includes a plug and a compression spring, so that the exit hole can be opened or closed properly according to the pressure of the compressed air. In operation, the compressed air produced in the cylinder can overcome the compressive force of the compression spring to enter the inner space of the air storage container. However, the compressed air stored in the air storage container can exert a back force on the plug, thus restraining the plug from being moved away from the exit hole. As a result, the piston body, which conducts reciprocating motion in relation to the cylinder, will be subjected to greater resistance. Therefore, the piston body may not move smoothly in relation to the cylinder, and thus the speed of inflating an object will become slow. Furthermore, the motor of the air compressor may become too hot, thus decreasing the performance of the motor. Even worse, the motor may be under the risk of burning out.

In view of the foregoing, the applicant intends to develop an improved air compressor which can solve the shortcomings of conventional air compressors.

SUMMARY OF THE INVENTION

One object of the present invention is to provide an improved air compressor, wherein a cylinder thereof defines a plurality of exit holes, and the cylinder is formed of a plastic material, integrally with a main frame which can be used for mounting a motor.

According to one feature of the present invention, the cylinder defines a plurality of exit hole, so that a large amount of compressed air produced in the cylinder may enter an air storage container in a short time.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
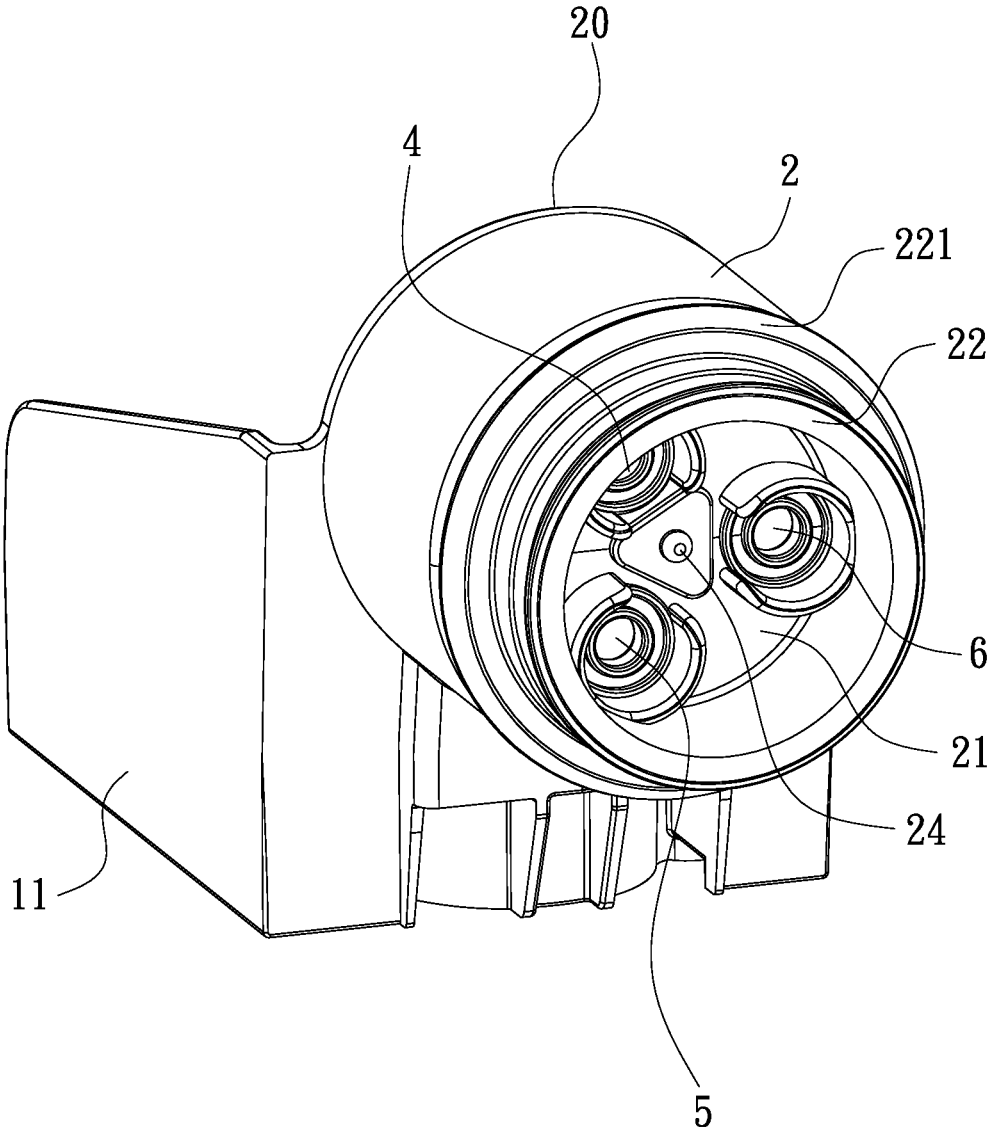
FIG. 1 shows a 3-dimensional view of a cylinder used in an air compressor of the present invention, wherein the cylinder is formed integrally with a main frame.
Figure 2:
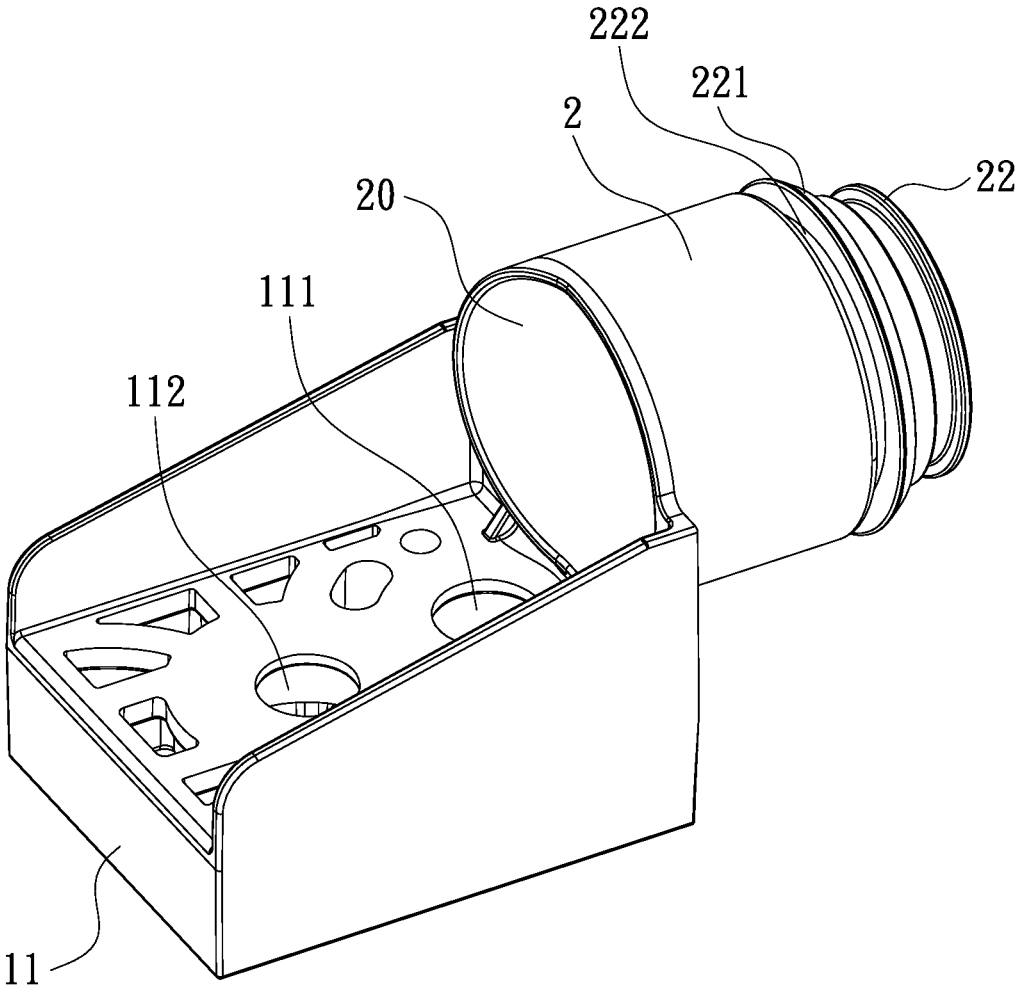
FIG. 2 shows a 3-dimensional view of the cylinder formed integrally with the main frame, which is viewed from a different angle.
Figure 3:
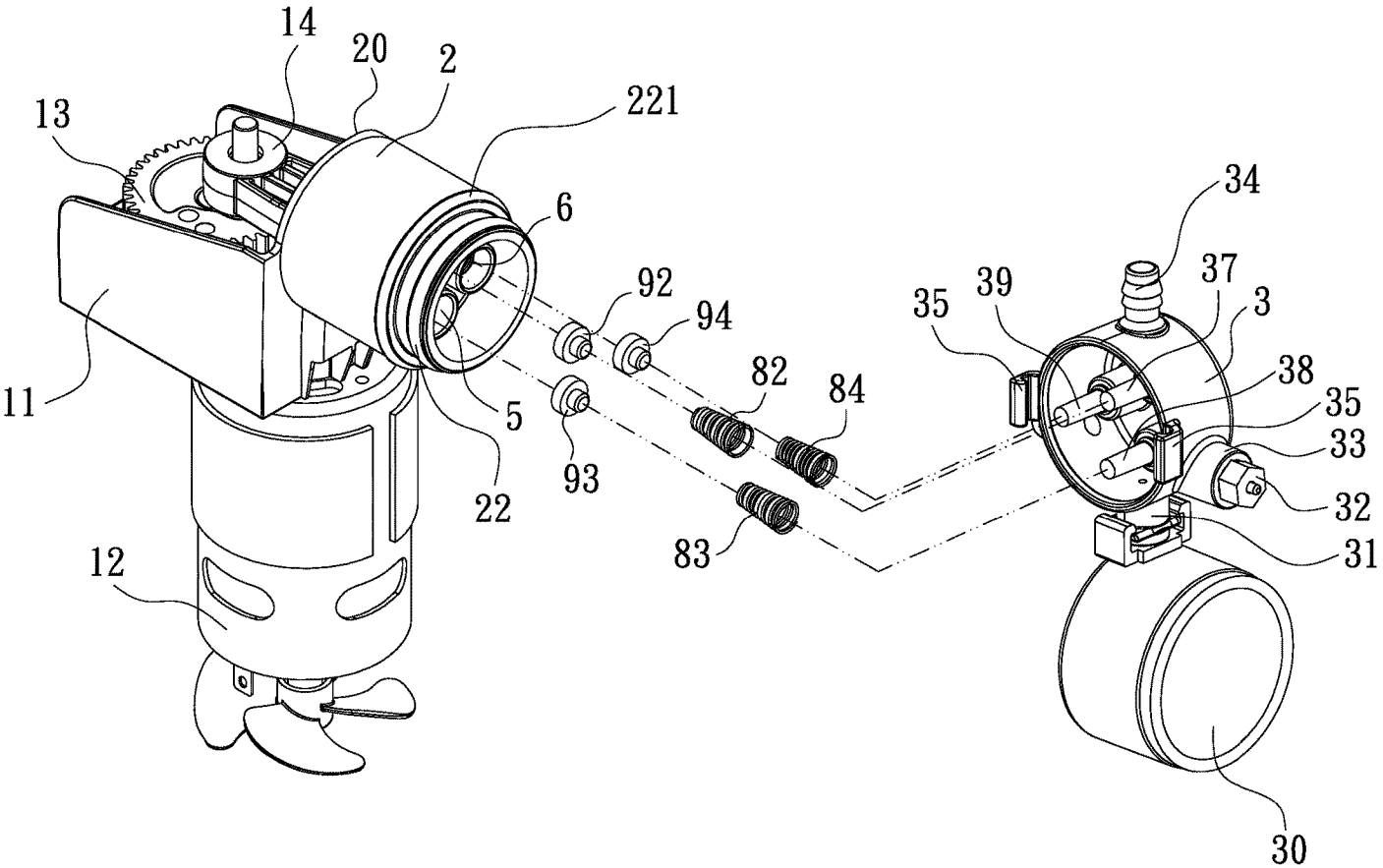
FIG. 3 shows an exploded view of a first embodiment of the air compressor of the present invention.
Figure 4:
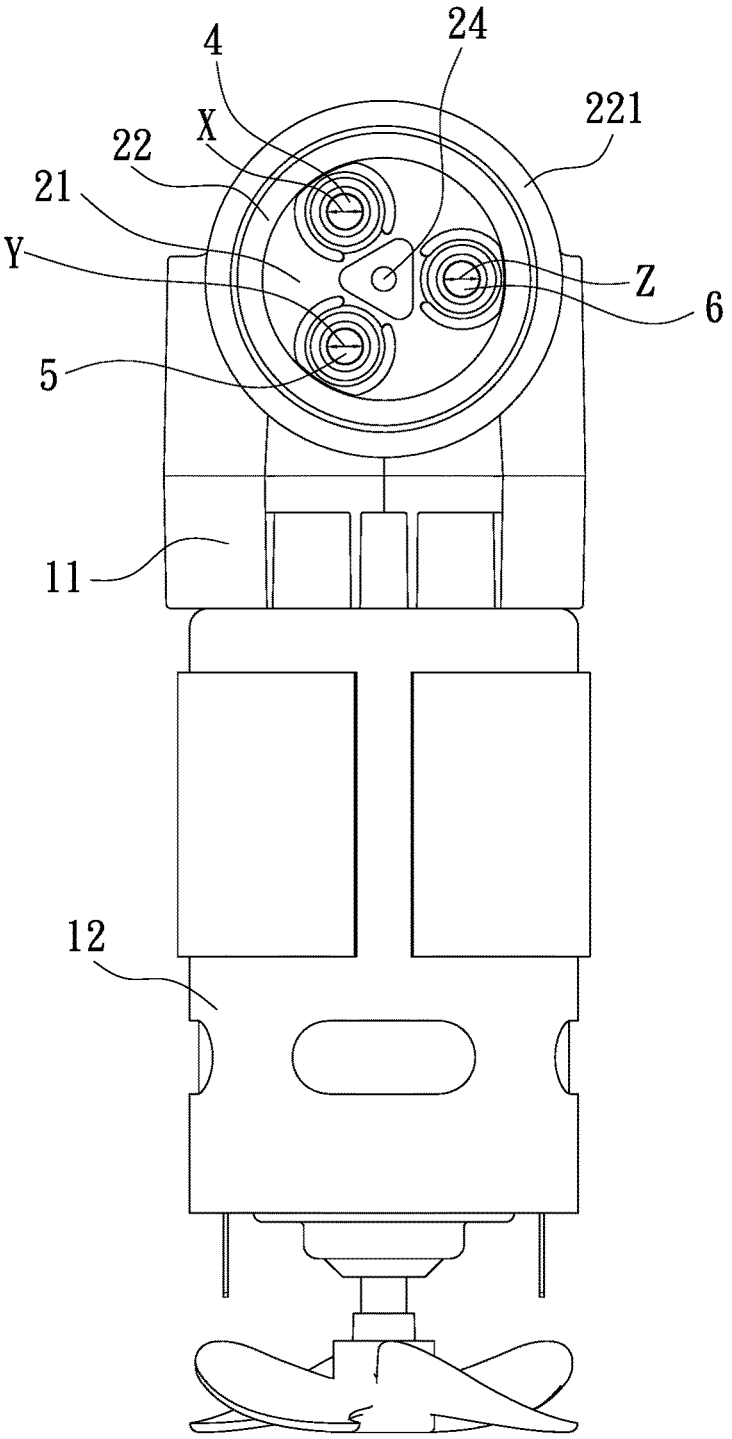
FIG. 4 shows a plan view of the first embodiment of the air compressor, wherein a plurality of exit holes defined at the cylinder are revealed.
Figure 5:
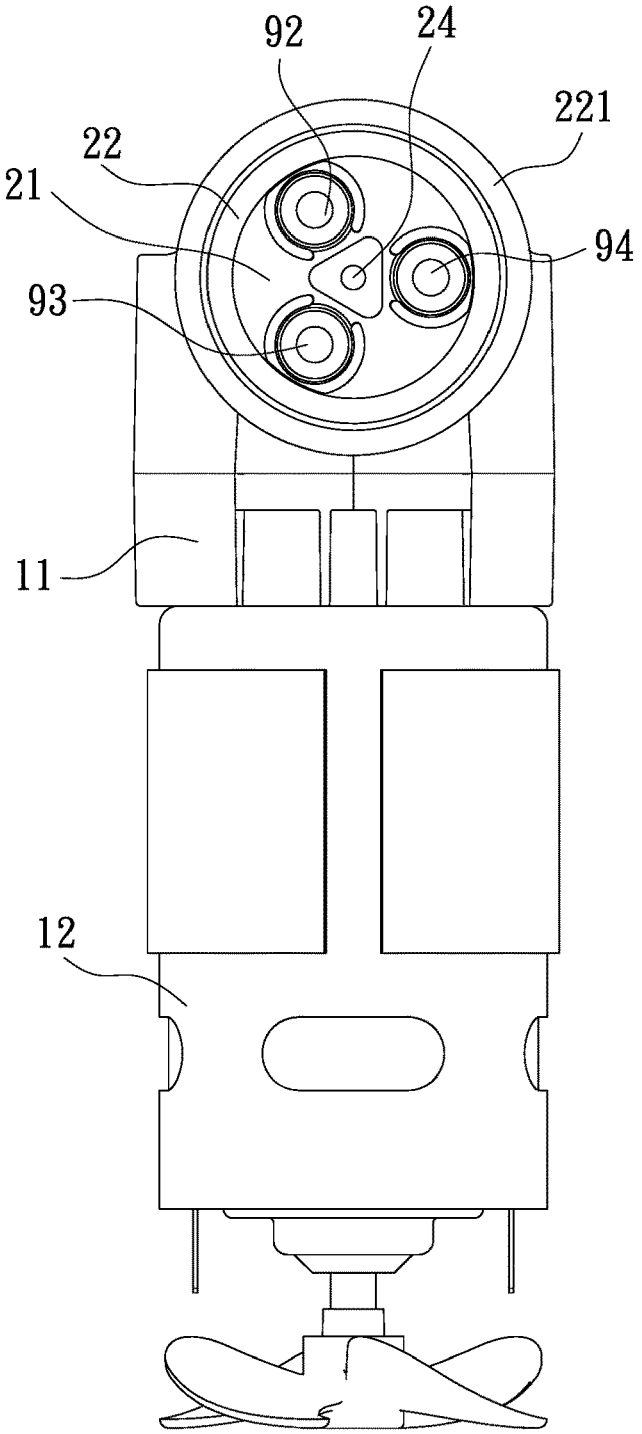
FIG. 5 shows a plan view of the first embodiment of the air compressor, wherein a plurality of plugs being used to seal the exit holes are revealed.

Referring to FIGS. 1 through 3, an air compressor according to a first embodiment of the present invention is shown, which generally comprises a cylinder 2 fitted with a piston body 14, and a main frame 11 for mounting a motor 12, wherein the cylinder 2 is formed integrally with the main frame 11 so that the cylinder 1 and the main frame 11 are made as a single body, the cylinder 2 and the main frame 11 are made of plastic material. The cylinder 2 has an open end 20, into which the piston body 14 can be fitted, and a top wall 21 opposite to the open end 20. The frame 11 defines an upper hole 111, through which the motor 12 can be mounted to the main frame 11, and a lower hole 112 for mounting a gear 13. The motor 12 can rotate the gear 13 to drive the piston body 14 to conduct reciprocating motion in relation to the cylinder 2, so that compressed air can be produced in the cylinder 2. The compressed air may enter an air storage container 3 by way of exit holes defined at the top wall 21. The air storage container 3 is provided with one or more outlets. For example, the outlet 31 can be connected with a pressure gauge 30; the outlet 33 can be connected with a relief valve 32; the outlet 34 can be connected with a hose (not shown) for inflating an object.

Figure 6:
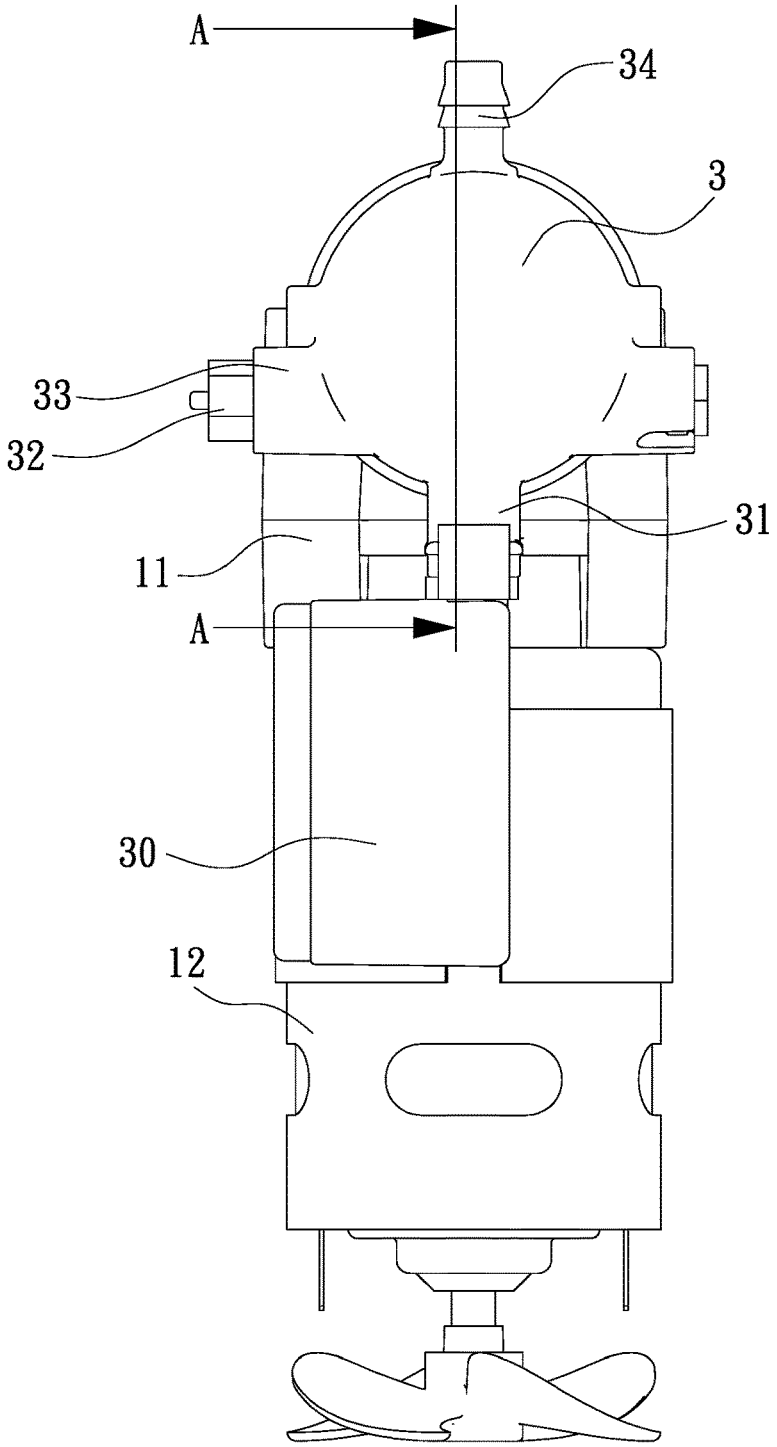
FIG. 6 shows a plan view of the first embodiment of the air compressor, wherein an air storage container is assembled onto the cylinder.
Figure 7:
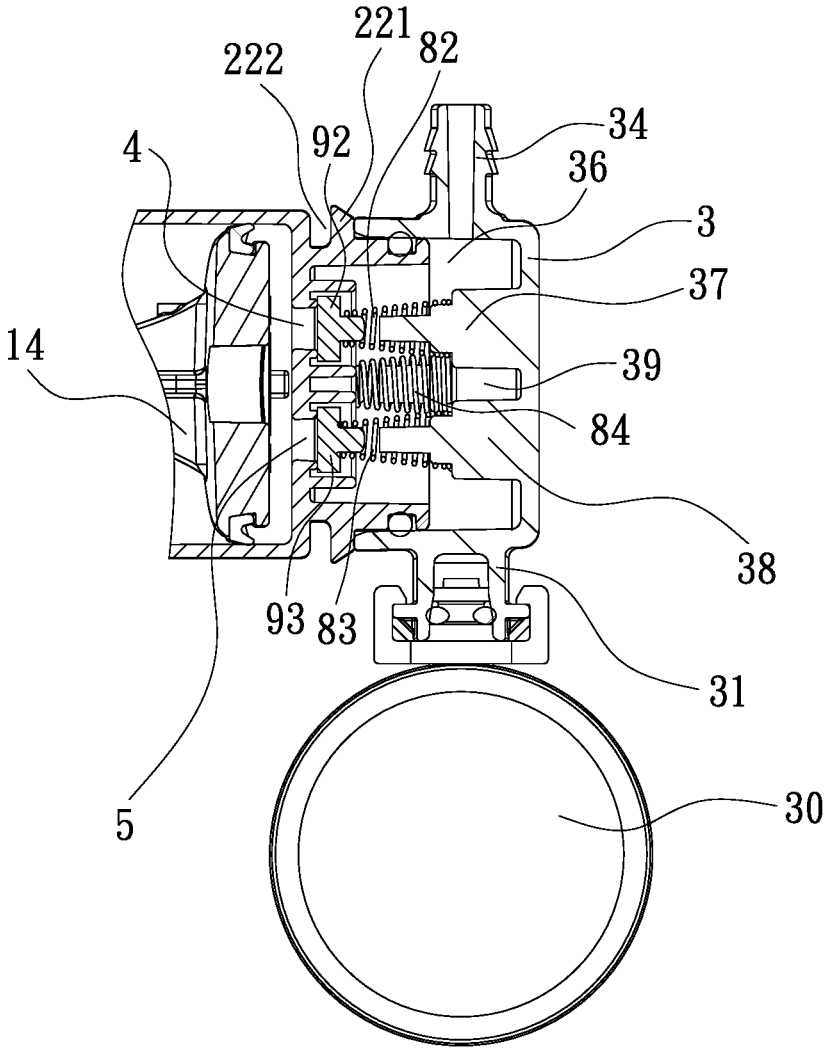
FIG. 7 shows a sectional view of the first embodiment of the air compressor taken along line A-A in FIG. 6.
Figure 8:
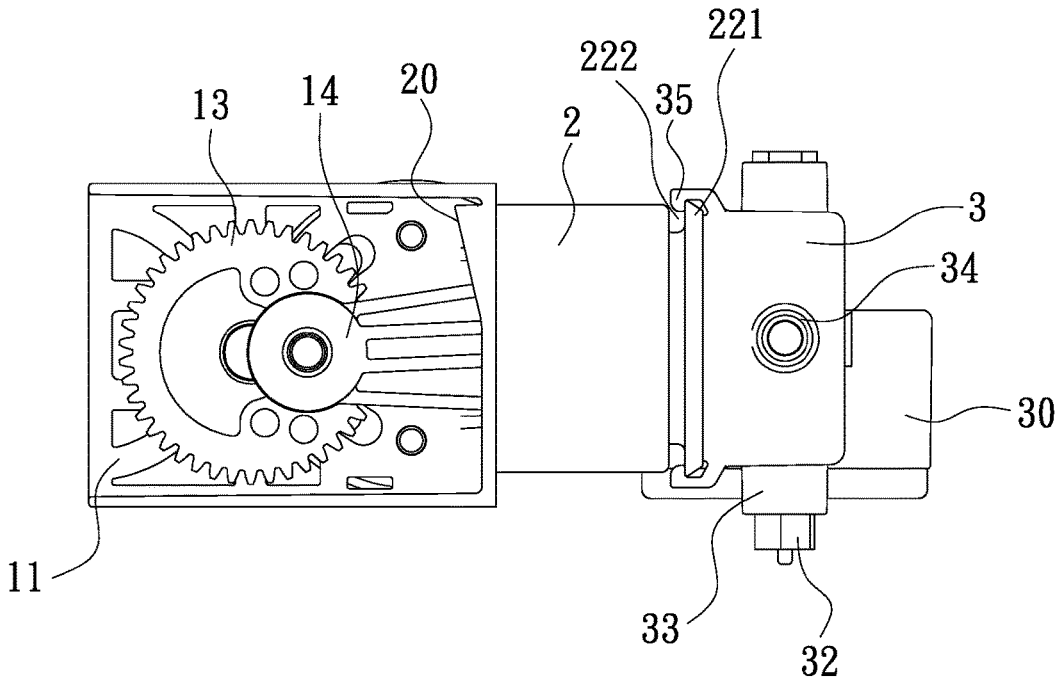
FIG. 8 shows a plan view of the first embodiment of the air compressor, wherein a gear and a piston body used in the air compressor are revealed.

Referring to FIGS. 1 through 7, the air compressor of the present invention is designed differently from conventional technology in which a single air exit port is used. In this embodiment, there are three exit holes 4, 5, 6 defined at the top wall 21 of the cylinder 2, and the main frame 11 is formed integrally with the cylinder 2. The exit holes 4, 5, 6 are defined to be approximately equal in diameter (see FIG. 4). The exit hole 4 is defined to have a diameter of (X), the exit hole 5 is defined to have a diameter of (Y), and the exit hole 6 is defined to have a diameter of (Z), wherein X=Y=Z. The exit holes 4, 5, 6 can be regulated by a control mechanism to be opened or closed. In this embodiment, the control mechanism includes a plurality of plugs 92, 93, 94 and a plurality of compression springs 82, 83, 84. The compression springs 82, 83, 84 can urge the plugs 92, 93, 94 to seal the exit holes 4, 5, 6, respectively (see FIGS. 3, 5 and 7). The cylinder 2 has a tubular projection 22 formed on the top wall 21. The tubular projection 22 is provided with a circular flange 221 at its outer surface and defines an annular groove 222 between the circular flange 221 and the top wall 21 (see FIGS. 1 and 2). The air storage container 3 is provided at a bottom edge thereof with two opposite coupling means 35, which can be inserted into the annular groove 222 and engaged with the circular flange 221 (see FIG. 8). Furthermore, the air storage container 3 is provided at an inner surface thereof with a plurality of columns 37, 38, 39 corresponding to the compression springs 82, 83, 84 (see FIG. 3). As shown in FIG. 7, each of the compression springs 82, 83, 84 has one end forcing against the corresponding plug 92, 93 or 94, and has another end being fitted around and forcing against the corresponding column 37, 38 or 39. Each of the columns 37, 38, 39 is located at a predetermined height above the corresponding plug so as to limit the movement of the corresponding plug, so that the compressed air can be controlled more easily to enter the air storage container 3. FIGS. 6 and 8 show the air storage container 3 being assembled onto the cylinder 2.

Referring to FIGS. 7 and 8, when the piston body 14 conducts reciprocating motion, the compressed air produced in the cylinder 2 can overcome the force of the compression springs 82, 83, 84 exerted on the plugs 92, 93, 94, thus pushing the plugs 92, 93, 94 away from the equal-diameter exit holes 4, 5, 6, respectively, so that the compressed air can flow into the inner space 36 of the air storage container 3. Initially, since the compressed air can flow into the inner space 36 of the air storage container 3 simultaneously via the exit holes 4, 5, 6, the air storage container 3 can be filled with a large amount of air in a short time. Later, since there is a large amount of air having entered the inner space 36 of the air storage container 3, the air contained in the air storage container 3 can exert a greater back force on the plugs 92, 93, 94 compared to the air initially contained in the air storage container 3. In other words, the piston body 14 may experience greater resistance in conducting reciprocating motion, and this may cause the exit holes 4, 5, 6 more difficult to be opened. However, upon a decrease of the pressure of the air contained in the air storage container 3, the back force exerted on the plugs 92, 93, 94 will decrease and this allows the compressed air produced in the cylinder 2 to quickly enter the inner space 36 of the air storage container 3. Considering the operation of the air compressor as a whole, since the multiple exit holes allow the piston body 14 to conduct reciprocating motion more smoothly, the performance of the air compressor can be increased. Thus, the air compressor can inflate an object more quickly.

Figure 9:
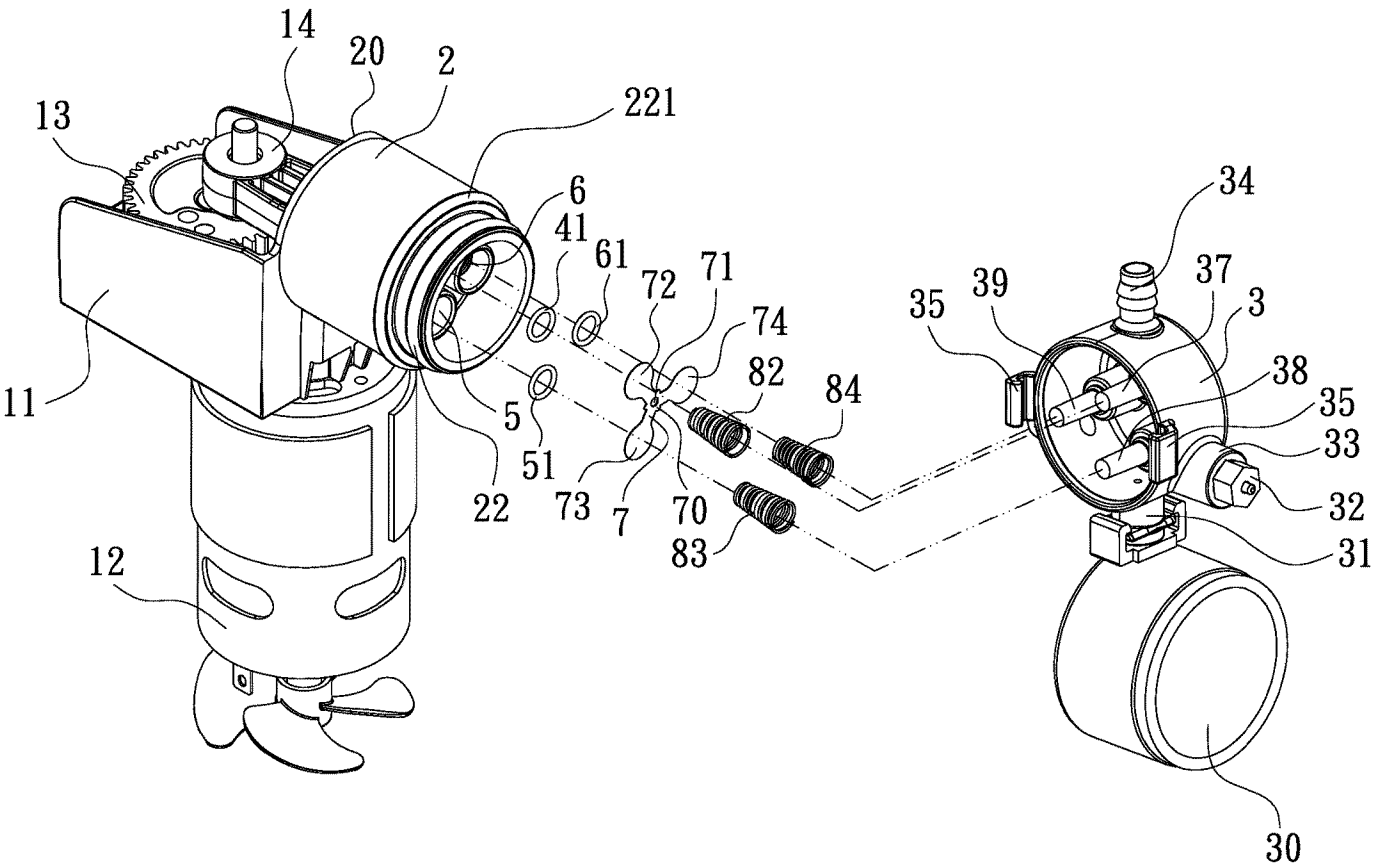
FIG. 9 shows an exploded view of a second embodiment of the air compressor of the present invention.
Figure 10:
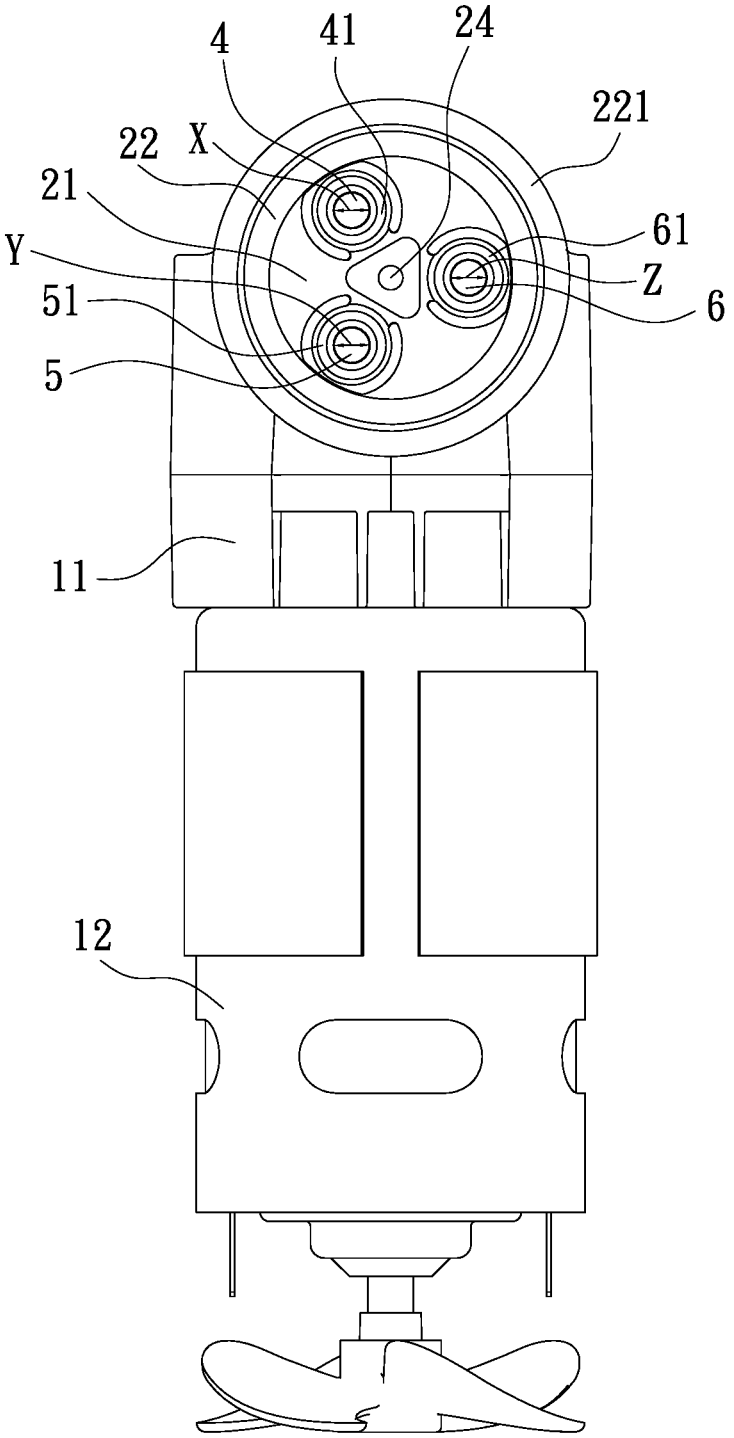
FIG. 10 shows a plan view of the second embodiment of the air compressor, wherein a plurality of exit holes defined at the cylinder and the associated O-rings are revealed.
Figure 11:
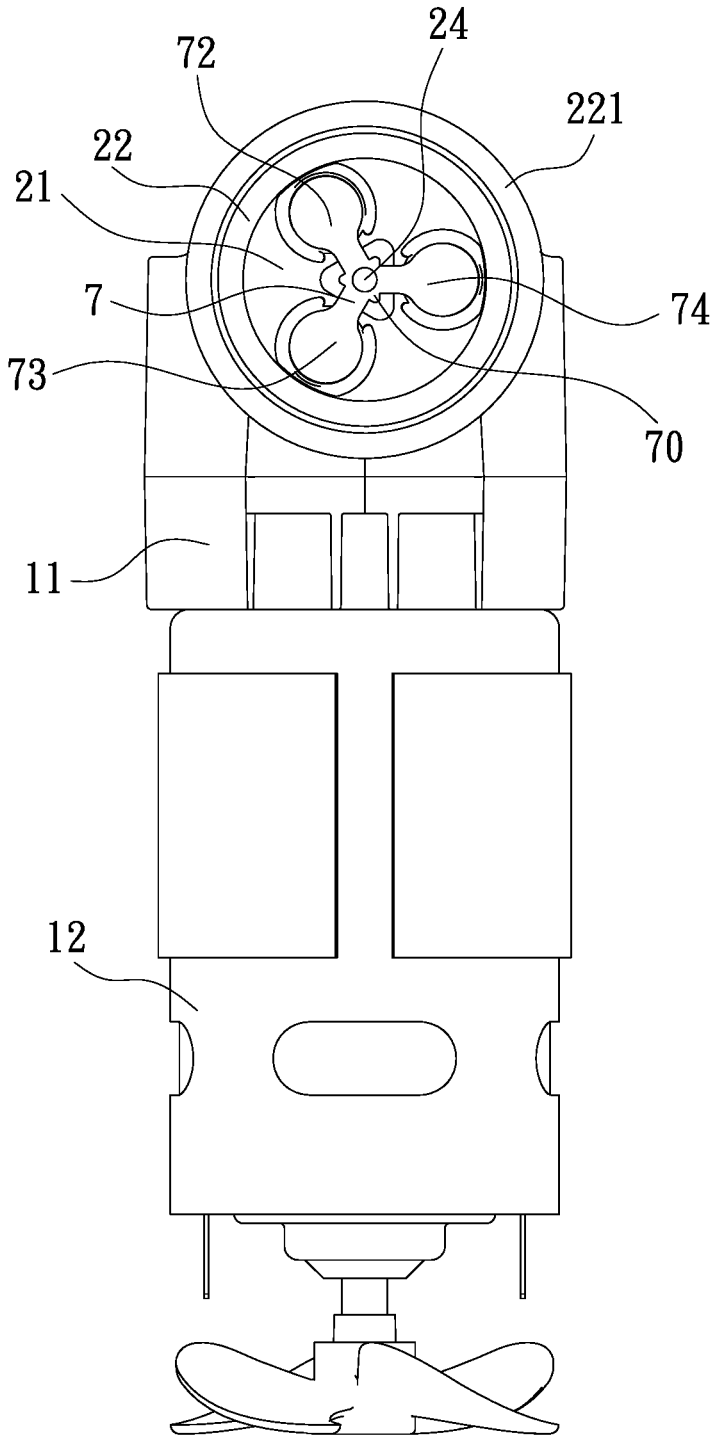
FIG. 11 shows a plan view of the second embodiment of the air compressor, wherein a resilient sheet being used to seal the exit holes is revealed.

FIGS. 9 through 11 show a second embodiment of the air compressor of the present invention, wherein the control mechanism includes a plurality of O-rings 41, 51, 61, which can be placed around the exit holes 4, 5, 6, a resilient sheet 7, and a plurality of compression springs 82, 83, 84. The resilient sheet 7 has a root 70 at its center and a plurality of branches 72, 73, 74 extending from the root 70 to appear as a star configuration and being configured to having a size sufficient for covering the exit holes 4, 5, 6. The root 70 of the resilient sheet 7 defines a positioning hole 71 and is attached to the top wall 21 by fitting the positioning hole 71 over a boss 24 provided at the top wall 21. The branches 72, 73, 74 of the resilient sheet 7 are urged by the compression springs 82, 83, 84 against the O-rings 41, 51, 61 to seal the exit holes 4, 5, 6, respectively, wherein the branch 72 is in tight contact with the O-ring 41, the branch 73 is in tight contact with the O-ring 51, and the branch 74 is in tight contact with the O-ring 61 (see FIGS. 10 and 11).

Figure 12:
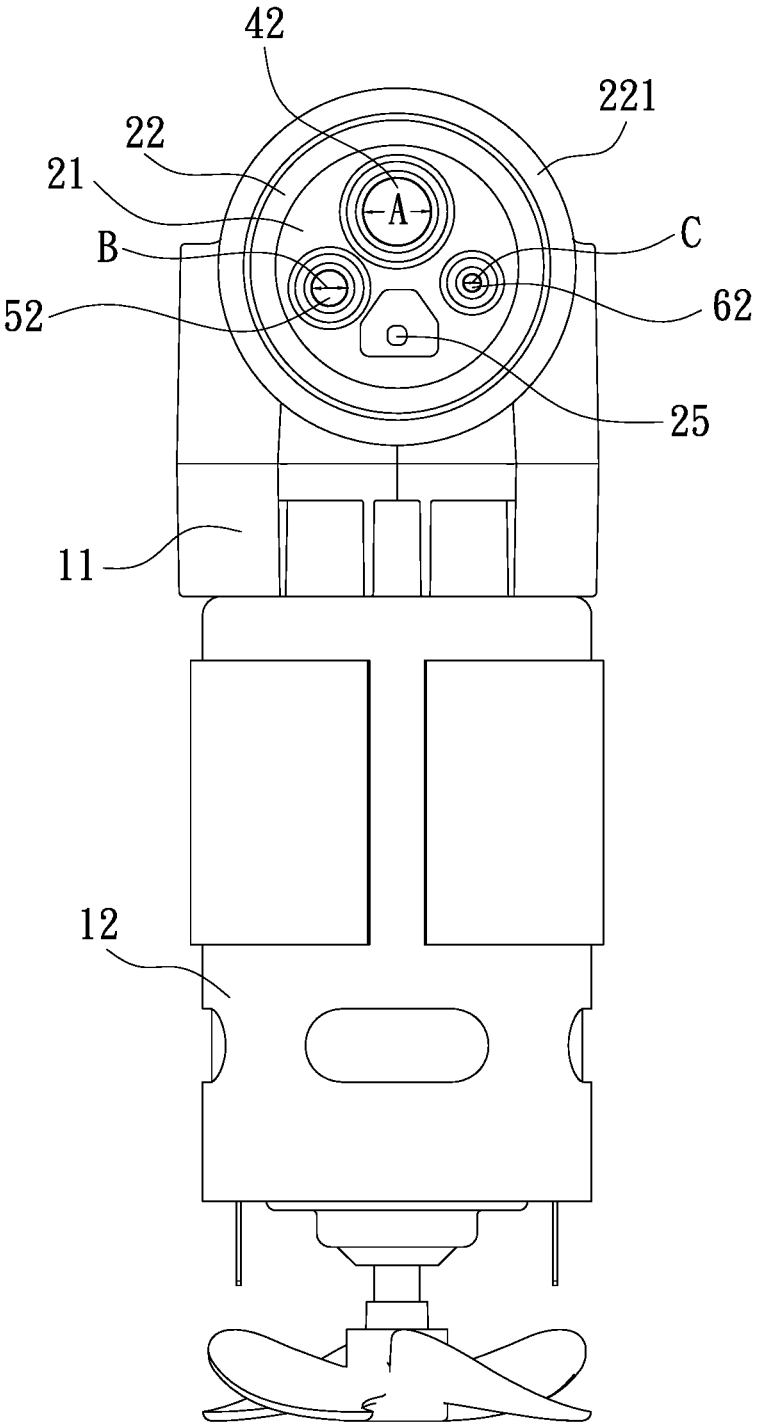
FIG. 12 shows a plan view of a third embodiment of the air compressor, wherein a plurality of exit holes with different diameters defined at the cylinder are revealed.
Figure 13:
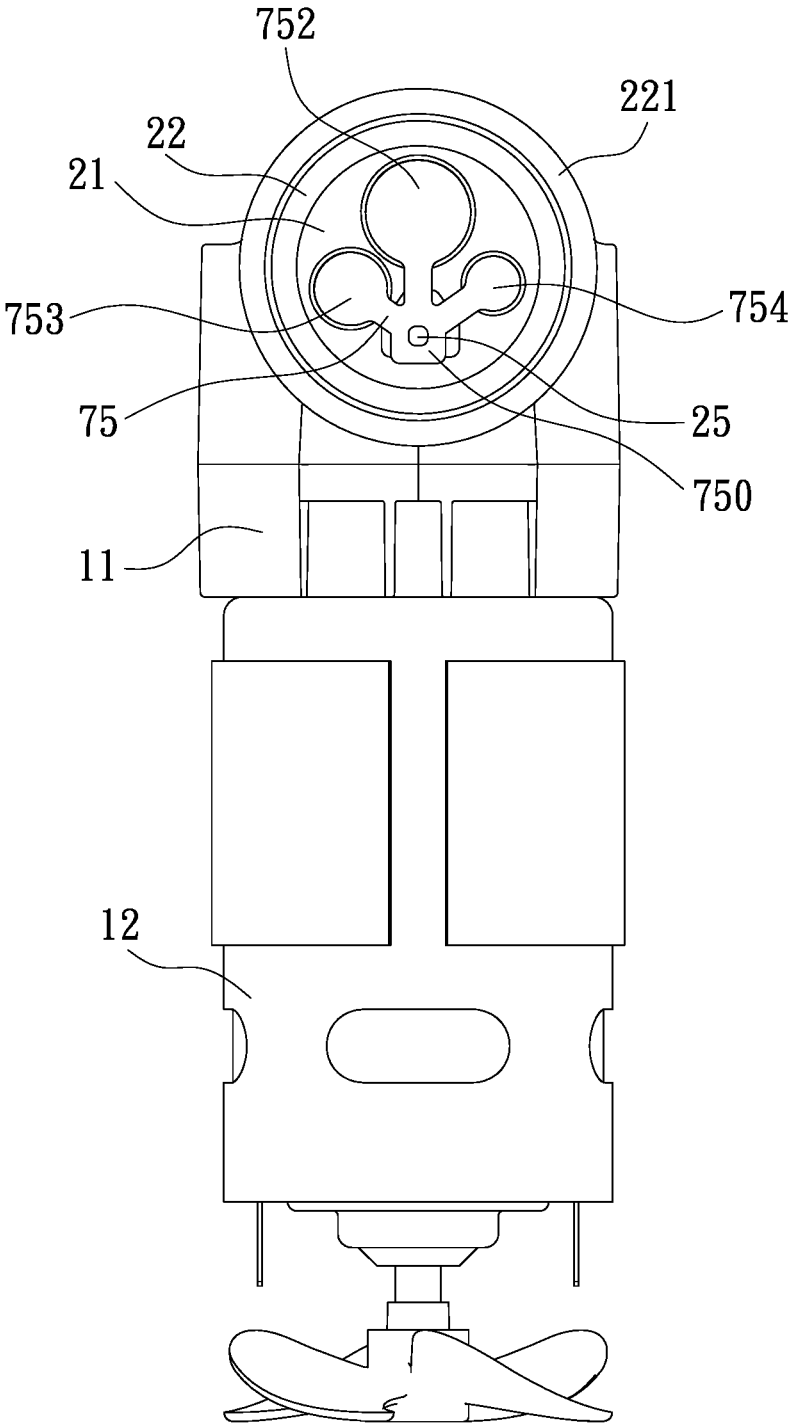
FIG. 13 shows a plan view of the third embodiment of the air compressor, wherein a resilient sheet being used to seal the exit holes is revealed.

FIG. 12 shows a third embodiment of the air compressor of the present invention. As shown, the cylinder 2 of the embodiment defines a plurality of exit holes 42, 52, 62 at its top wall 21, wherein the exit hole 42 has a diameter of (A), the exit hole 52 has a diameter of (B), and the exit hole 62 has a diameter of (C), wherein A>B>C. The exit holes 42, 52, 62 are regulated by a control mechanism to be opened or closed. In this embodiment, the control mechanism includes a plurality of O-rings (not shown) corresponding to the exit holes 42, 52, 62, a resilient sheet 75, and a plurality of compression springs (not shown). The resilient sheet 75 has a root 750 and a plurality of branches 752, 753, 754 extending upwardly from the root 750 to appear as a dendritic configuration and being configured to have a size sufficient for covering the exit holes 42, 52, 62 (see FIG. 13). The root 750 of the resilient sheet 75 defines a positioning hole (similar to that of the second embodiment) and is attached to the top wall 21 by fitting the positioning hole over a boss 25 provided at the top wall 21 (see FIG. 13). The branches 752, 753, 754 of the resilient sheet 75 can be urged by the compression springs against the O-rings to seal the exit holes 42, 52, 62, respectively. The branch 752 of the resilient sheet 75 has an area of (R) for covering the exit hole 42. The branch 753 of the resilient sheet 75 has an area of (M) for covering the exit hole 52. The branch 754 of the resilient sheet 75 has an area of (N) for covering the exit hole 62 (see FIG. 13), wherein R>M>N.

As a summary, the air compressor of the present invention has a breakthrough over the prior art in that the top wall 21 of the cylinder 2 defines a plurality of exit holes, which are regulated by a control mechanism to allow the compressed air produced in the cylinder 2 to quickly enter the inner space 36 of the air storage container 3, so that the piston body 14 can conduct reciprocating motion more smoothly and thus the performance of the air compressor can be increased. These features render the air compressor of the present invention useful and inventive.

I claim:

1. In an air compressor including a main frame for mounting a motor, and a cylinder having an open end and a top wall opposite to the open end, the open end allowing a piston body to be fitted into the cylinder, the top wall defining an exit hole which allows compressed air produced in the cylinder to enter an air storage container while the piston body conducts reciprocating motion; wherein the improvement comprises:

the top wall defines an additional exit hole, and the cylinder and the main frame are integrally formed of a plastic material; wherein the cylinder has a tubular projection formed on the top wall, the tubular projection provided at its outer surface with a circular flange and defining an annular groove between the circular flange and the top wall; the air storage container is provided at a bottom edge thereof with two opposite coupling means and provided at an inner surface thereof with a plurality of columns, the two coupling means capable of being inserted into the annular groove and engaged with the circular flange.

2. The air compressor of claim 1, wherein the exit holes are defined to be approximately equal in diameter.

3. The air compressor of claim 1, wherein the exit holes are regulated by a control mechanism to be opened or closed, the control mechanism including a plurality of plugs and a plurality of compression springs each capable of urging a corresponding plug to seal a corresponding exit hole.

4. The air compressor of claim 3, wherein each of the compression springs has one end forcing against the corresponding plug, and has another end being fitted around and forcing against the corresponding column, so that the exit holes can be sealed properly, wherein each of the columns is located at a predetermined height above the corresponding plug so as to limit the movement of the corresponding plug to facilitate controlling the compressed air entering the air storage container.

5. The air compressor of claim 1, wherein the exit holes are regulated by a control mechanism to be opened or closed, the control mechanism including a plurality of O-rings, a resilient sheet, and a plurality of compression springs capable of urging the resilient sheet to seal the exit holes.

6. The air compressor of claim 5, wherein the resilient sheet has a root at a center thereof and a plurality of branches extending from the root to appear as a star configuration and being configured to have a size sufficient for covering the exit holes, the O-rings being placed around the exit holes respectively, the root of the resilient sheet defining a positioning hole and attached to the top wall by fitting the positioning hole over a boss provided at the top wall, the compression springs urging the branches of the resilient sheet against the O-rings to seal the exit holes, respectively.

7. The air compressor of claim 5, wherein the resilient sheet has a root and a plurality of branches extending upwardly from the root to appear as a dendritic configuration and being configured to have a size sufficient for covering the exit holes, the O-rings being placed around the exit holes, the root of the resilient sheet defining a positioning hole and attached to the top wall by fitting the positioning hole over a boss provided at the top wall, the branches of the resilient sheet being urged by the compression springs against the O-rings to seal the exit holes, respectively.

8. The air compressor of claim 1, wherein the exit holes are defined to have different diameters.

* * * * *